United States Patent [19]

Cohen

[11] 4,241,917

[45] Dec. 30, 1980

[54] GOLF TEE

[76] Inventor: Murray Cohen, 4 Stoneham, Livingston, N.J. 07424

[21] Appl. No.: 965,694

[22] Filed: Dec. 1, 1978

[51] Int. Cl.[3] ..... A63B 57/00

[52] U.S. Cl. ..... 273/33; 273/162 C

[58] Field of Search ..... 273/32 D, 33, 201, 203, 273/208, 183 A, 202, 162 C, 162 R, 162 A, 162 B, 162 D, 162 F; 224/919, 45 L, 252, 274

[56] References Cited

U.S. PATENT DOCUMENTS

| | | | |
|---|---|---|---|
| 1,625,911 | 4/1927 | Richards | 273/202 |
| 1,779,995 | 10/1930 | Trane | 273/203 |
| 3,870,300 | 3/1975 | Amendola | 273/32 D |
| 3,883,144 | 5/1975 | Lazow | 273/33 |

*Primary Examiner*—Richard C. Pinkham
*Assistant Examiner*—T. Brown
*Attorney, Agent, or Firm*—David A. Jackson

[57] ABSTRACT

A golf tee, comprising an elongated shank member, an enlarged, cupped head member attached to one end of the shank member for supporting a golf ball thereon, and a limiting member attached to the shank member for limiting the extent of insertion of the shank member into the ground to locate the cupped head member at a determined level above ground level and for releasably attaching the golf tee to a golf club shaft when the golf tee is not being utilized, the limiting member including an elongated, substantially U-shaped member.

6 Claims, 6 Drawing Figures

GOLF TEE

BACKGROUND OF THE INVENTION

This invention relates to a golf tee. More particularly, the present invention relates to a golf tee which is automatically adjusted in height upon insertion into the ground and which can be releasably attached to a golf club shaft when not being utilized.

It is well known to use a golf tee which includes means for limiting the extent of insertion of the tee into the ground to locate the ball carrying portion of the tee at a selected level above the ground. Many of these golf tees utilize flat members having at least one aperture through which the shank of a golf tee is inserted before inserting the tee into the ground. See for example U.S. Pat. Nos. 1,625,911 to Richards and 3,883,144 to Lazow. Other devices utilize golf tees which are screw-threadedly received within a golf tee holder for adjusting the height thereof. See for example U.S. Pat. No. 1,779,995.

However, another problem inherent with conventional golf tees and golf tee limiting members is where to put them after the golfer has completed his drive shot and picks up his tee. Typically, a golfer merely places the golf tee into his pocket until the next hole. In this manner, the golf tee often makes holes in the golfer's pockets. In addition, there is the problem of finding the golf tee in the golfer's pocket when the golf tee is mixed with keys, loose change or a wallet, or any combination thereof.

No patents are known to the inventor in which an attachment is provided to the golf tee for clipping the golf tee onto the shaft of a golf club when the tee is not being utilized. The only patent known to the inventor that utilizes a clip-on feature is U.S. Pat. No. 3,870,300 to Amendola in which a cylindrical split ferrule is utilized in conjunction with an elongated spine for providing a golf club rake in which a plurality of golf tees are disposed within the spine. Such a device does not utilize a limiting member attached to the shank of a golf tee for limiting the extent of insertion of the shank member into the ground and for releasably attaching the golf tee to a golf club shaft when the golf tee is not being utilized.

Accordingly, it is believed that the present invention provides a unique solution to these aforementioned problems.

SUMMARY OF THE INVENTION

In accordance with the present invention, a golf tee is provided, comprising an elongated shank member, an enlarged, cupped head member attached to one end of the shank member for supporting a golf ball thereon, and a limiting member attached to the shank member for limiting the extent of insertion of the shank member into the ground to locate the cupped head member at a determined level above ground level and for releasably attaching the golf tee to a golf club shaft when the golf tee is not being utilized, the limiting member including an elongated, substantially U-shaped member.

Accordingly, it is a principal object of the present invention to provide a golf tee having a limiting member which limits the extent of insertion of the shank member of the golf tee into the ground to locate the cupped head member at a determined level above ground level and for releasably attaching the golf tee to a golf club shaft when the golf tee is not being utilized.

It is a further object of the present invention to provide a golf tee in which the limiting member includes an elongated, substantially U-shaped member for clipping onto a golf club shaft when the golf tee is not being utilized.

It is a still further object of the present invention to provide a golf tee which is easy and economical to manufacture.

Further ojbects and advantages will become apparent to those skilled in the art from the ensuing description which proceeds with reference to the accompanying Figures.

DESCRIPTION OF THE PREFERRED EMBODIMENTS

Figure 1:
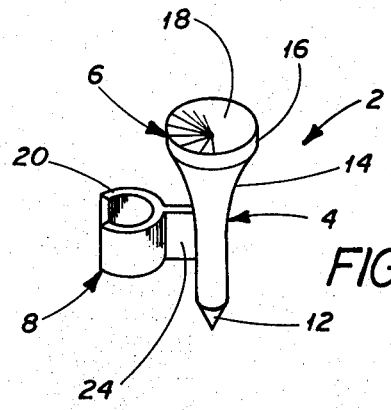
FIG. 1 is a perspective view of one embodiment of the golf tee of the present invention with its limiting member.

Referring to the drawings, wherein like numerals represent like parts, and particularly to FIG. 1, the present invention comprises a golf tee 2 having an elongated shank member 4, an enlarged, cupped head member 6 attached to one end of shank member 4, and a limiting member 8 attached to shank member 4 for limiting the extent of insertion of shank member 4 into the ground to locate head member 6 at a determined level above ground level and for releasably attaching golf tee 2 to a golf club shaft 10 when golf tee 2 is not being utilized.

Referring to the Figure, shank member 4 is of an elongated dimension, having a pointed tip 12 at one end thereof. In a preferred embodiment, although not essential to the present invention, the end of shank member 4 opposite tip 12 may include an outwardly flared section 14.

Attached to outwardly flared section 14 is an enlarged, cupped head member 6 having a slightly raised portion 16 and a concave, cupped, ball receiving top surface 18. In this manner, a conventional golf tee has so far been defined.

Golf tee 2 also includes a limiting member 8 attached to shank member 4 for limiting the extent of insertion of shank member 4 into the ground to locate cupped head member 6 at a determined level above ground level and for releasably attaching golf tee 2 to golf club shaft 10 when golf tee 2 is not being utilized. Limiting member 8 includes an elongated, substantially U-shaped member 20. As shown in FIGS. 1–5, one embodiment of U-shaped member 20 is of a hollow, partially open, cylindrical U-shaped configuration. A second embodiment of U-shaped member 20 is shown in FIG. 6 as having a substantially rectangular, cross-sectional U-shaped configuration having opposing, inner, longitudinal grooves or channels 22, to be later discussed. U-shaped member 20 is preferably made from any durable but flexible material, such as a suitable plastic.

Figure 2:
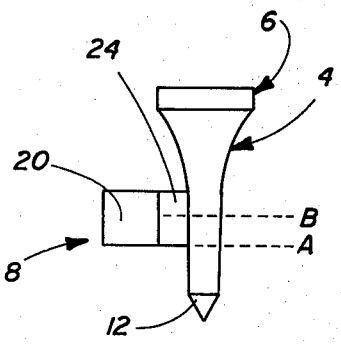
FIG. 2 is a side plan view of the invention of FIG. 1.
Figure 3:
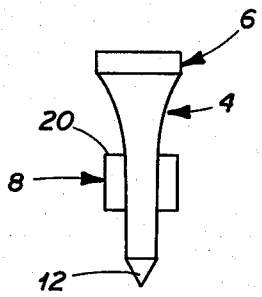
FIG. 3 is a side plan view of the invention of FIG. 1 and at a right angle to FIG. 2.
Figure 4:
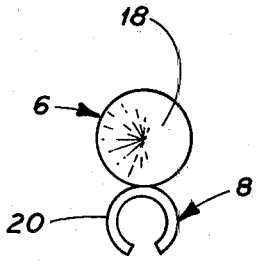
FIG. 4 is a top plan view of the invention of FIG. 1.

Referring to FIGS. 1, 2 and 6, limiting member 8 may also include an attaching member 24 for attaching U-shaped member 20 to shank 4 of golf tee 2. Attaching member 24 may be of any suitable configuration but is preferably of an elongated, rectangular cross-sectional configuration, as shown in FIG. 6. Attaching member 24 may be attached to any outer portion of U-shaped member 20. For example, as shown in the Figures, attaching member 24 can be attached to the bottom of U-shaped member 20 or, as shown in FIG. 6, attaching member 24' can be attached to an outer side of U-shaped member 20. The side of attaching member 24 opposite U-shaped member 20 is attached to shank member 4 of golf tee 2. Preferably, U-shaped member 20, attaching member 24 and shank member 4 are integrally molded from a suitable plastic material.

U-shaped member 20 and attaching member 24 can be attached at various heights along shank member 4 for utilization with different golf clubs. The lower U-shaped member 20 is disposed along shank member 4, the less shank member 4 can be inserted into the ground, resulting in a golf ball 26, resting on golf tee 2, being at a higher height. As shown in FIG. 2, a U-shaped member 20 having its lower edge disposed at level B can be inserted further into the ground than a U-shaped member 20 having its lower edge attached to shank member 4 at level A. For example, a golfer would necessarily adjust his golf tee height higher for a driver wood than he would for a fairway wood. Thus, golf tees with various height U-shaped members 20 could be manufactured.

Figure 5:
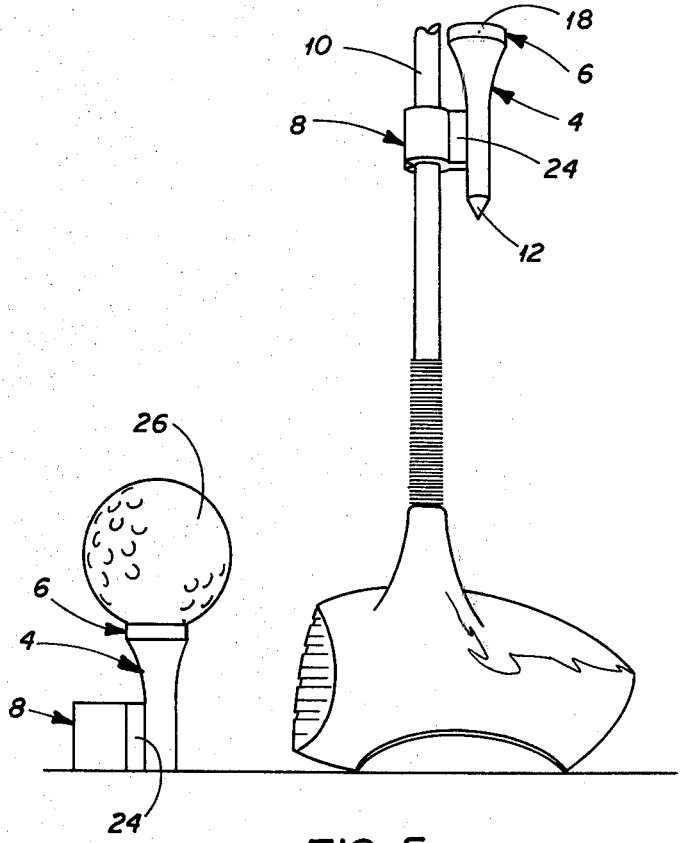
FIG. 5 is a perspective view of the present invention of FIG. 1 in use as a golf tee and as clipped onto a golf club shaft.
Figure 6:
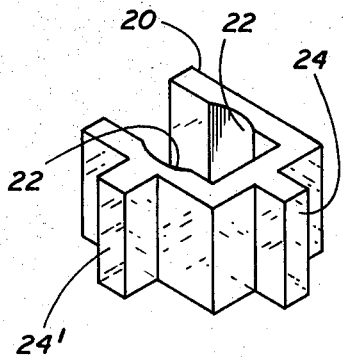
FIG. 6 is a second embodiment of a limiting member that can be utilized with the present invention.

As shown in FIG. 5, when golf tee 2 is desired to be utilized, it is inserted into the ground and because of the attachment of U-shaped member 20, golf tee 2 is limited in the extent of insertion of its shank member 4 into the ground in order to locate cupped head member 6, and consequently golf ball 26, at a determined level above ground level. After golf ball 26 is hit, golf tee 2 is removed from the ground and clipped onto golf club shaft 10. Because of the resiliency in U-shaped member 20, U-shaped member 20 will deform slightly such that the arms thereof are pushed outwardly to allow U-shaped member 20 to clip onto golf club shaft 10, whereupon the arms thereof encircle golf club shaft 10. In the case of the second embodiment of U-shaped member 20, as shown in FIG. 6, the arms of U-shaped member 20 will deform slightly and golf club shaft 10 will clip onto and rest within grooves 22 thereof.

It is to be understood that the invention is not limited to the illustrations described and shown herein, which are deemed to be merely illustrative of the best modes of carrying out the invention and which are suitable of modification of form, size, arrangement of parts and details of operation. The invention rather is intended to encompass all such modifications which are within the spirit and scope as defined by the claims.

What is claimed is:

1. A golf tee, comprising:

an elongated shank member;

an enlarged, cupped head member attached to one end of said shank member for supporting a golf ball thereon;

a limiting member attached to said shank member for limiting the extent of insertion of said shank member into the ground to locate said cupped head member at a predetermined level above ground level, said limiting member being attached in parallel relation to the longitudinal dimension of said shank member and along one side thereof;

said limiting member including a golf club mounting means, said mounting means being adapted to releasably hold said golf tee on a golf club shaft with said shank member disposed in parallel relation thereto, said mounting means defining a member of substantially U-shaped configuration.

2. The golf tee of claim 1 wherein said elongated shank member includes a pointed tip at the end thereof opposite said end where said head member is attached.

3. The golf tee of claim 1 wherein said elongated shank member includes an outwardly flared section at the end of said shank member where said head member is attached.

4. The golf tee of claim 1 wherein said U-shaped member is elongated and cylindrical.

5. The golf tee of claim 1 wherein said U-shaped member being of an elongated rectangular cross-section.

6. The golf tee of claim 5 wherein said U-shaped member includes at least one inner, longitudinal groove.

* * * * *